US009835410B2

(12) United States Patent
Morgan et al.

(10) Patent No.: US 9,835,410 B2
(45) Date of Patent: Dec. 5, 2017

(54) ROTATABLE HOLSTER

(71) Applicants: Randall Jay Morgan, Lebanon, PA (US); Salvatore Mannino, Lebanon, PA (US)

(72) Inventors: Randall Jay Morgan, Lebanon, PA (US); Salvatore Mannino, Lebanon, PA (US)

(73) Assignee: BLUE LINE TACTICAL, LLC, Lebanon, PA (US)

( * ) Notice: Subject to any disclaimer, the term of this patent is extended or adjusted under 35 U.S.C. 154(b) by 134 days.

(21) Appl. No.: 14/797,231

(22) Filed: Jul. 13, 2015

(65) Prior Publication Data

US 2016/0025451 A1 Jan. 28, 2016

Related U.S. Application Data

(60) Provisional application No. 62/027,821, filed on Jul. 23, 2014.

(51) Int. Cl.
*F41C 33/02* (2006.01)
*F41C 33/04* (2006.01)

(52) U.S. Cl.
CPC ..... *F41C 33/0272* (2013.01); *F41C 33/02* (2013.01); *F41C 33/0236* (2013.01); *F41C 33/0263* (2013.01); *F41C 33/043* (2013.01); *F41C 33/045* (2013.01); *F41C 33/048* (2013.01)

(58) Field of Classification Search
CPC .. F41C 33/0272; F41C 33/0263; F41C 33/02; F41C 33/0236; F41C 33/043; F41C 33/045; F41C 33/048
USPC ..... 224/198
See application file for complete search history.

(56) References Cited

U.S. PATENT DOCUMENTS

| | | | |
|---|---|---|---|
| 2,951,622 | A | 9/1960 | Heim |
| 3,003,670 | A | 10/1961 | Stalla |
| 3,227,337 | A | 1/1966 | Santo, Jr. |
| 3,252,638 | A | 5/1966 | Rolston et al. |
| 3,629,900 | A | 12/1971 | Beerli, Jr. |
| 3,688,953 | A | 9/1972 | Bianchi |

(Continued)

FOREIGN PATENT DOCUMENTS

| | | | |
|---|---|---|---|
| CS | 234905 | B1 | 4/1985 |
| EP | 0516292 | A1 | 12/1992 |
| WO | 2008/018915 | A2 | 2/2008 |

*Primary Examiner* — Derek Battisti
(74) *Attorney, Agent, or Firm* — Patent Law Associates

(57) ABSTRACT

A mounting assembly for securing a holster to a user that permits a holstered weapon to be rotated from a normal, dominant-hand accessible position to a reversed position more easily accessible to a non-dominant hand. The assembly includes a first portion that is securable to a user and a second portion hingedly connected to the first portion in a manner allowing rotation about a generally upstanding axis. The second portion is rotatable between a normal position which enables the user to draw the weapon using a dominant hand and a reversed position in which the holster is rotated to enable the user to conveniently draw the weapon using an off-hand. The assembly includes provisions to restrain the second portion in one or more predetermined orientations, biasing mechanisms to rotate the second portion when released, and latching mechanism to prevent inadvertent or unintended rotation of a holstered weapon.

20 Claims, 8 Drawing Sheets

(56) References Cited

U.S. PATENT DOCUMENTS

| | | | | | |
|---|---|---|---|---|---|
| 3,731,858 | A | | 5/1973 | Baker | |
| 4,408,706 | A | | 10/1983 | Hurley | |
| 5,327,288 | A | | 7/1994 | Wellington et al. | |
| 5,372,288 | A | * | 12/1994 | Rogers | A45F 5/00 224/198 |
| 5,598,958 | A | * | 2/1997 | Ryan, III | F41C 33/045 224/192 |
| 5,875,944 | A | * | 3/1999 | Beletsky | A45F 5/02 224/198 |
| 6,161,741 | A | | 12/2000 | French | |
| 6,585,209 | B1 | * | 7/2003 | Mattingly | F41C 33/0245 248/121 |
| 7,690,541 | B2 | | 4/2010 | Pellegrini | |
| 7,922,050 | B2 | | 4/2011 | Benes | |
| 8,215,525 | B2 | * | 7/2012 | Rassias | F41C 33/0236 224/192 |
| 9,126,328 | B2 | * | 9/2015 | Brandeis | A45F 5/02 |
| 9,360,276 | B1 | * | 6/2016 | Meek | F41C 33/041 |
| 2003/0205594 | A1 | * | 11/2003 | Rassias | F41C 33/0227 224/192 |

* cited by examiner

ROTATABLE HOLSTER

CROSS REFERENCE TO RELATED APPLICATIONS

This application claims the benefit of priority of U.S. Provisional Application 62/027,821, filed Jul. 23, 2014.

BACKGROUND OF THE INVENTION

This invention relates generally to a holster for a firearm and, more particularly to a sidearm holster that rotates in a manner to enable easy drawing and re-holstering of a firearm with either hand.

A typical handgun holster positions the weapon on the belt or waistband of a user with the muzzle pointed down and the grip roughly parallel to the ground and pointed to the rear of the user. Holsters used by police and military personnel often use a retention system to prevent the weapon from being accidentally released from the holster. In such holsters, one or more actions must be taken before the weapon can be drawn, such as activating a release. Retention systems provide more security so that the weapon can only be removed when the user so desires. More significantly, retention systems make removal of the weapon is difficult for an assailant, particularly an assailant facing the user. The downside of most retention systems is that the actions required to release and draw the weapon are very difficult to perform except with the dominant hand of the user. If the user's dominant hand, arm, or shoulder becomes injured or otherwise immobile, drawing the handgun using the non-dominate hand can become very difficult and thus put the user's life at risk.

Currently police and military tactical training involves situations where a police officer or military operator sustains injury to his or her dominant hand, making it difficult or impossible to draw a firearm. Training for these situations typically involves practicing drawing the firearm with the off or non-dominant hand while the dominant hand is secured in place to simulate an injury. Current training methods for this situation include pulling or rotating the duty belt towards the non-dominant hand for easier access to firearm. This method is difficult and slow, as duty belts are secured in place so as to prevent duty gear from shifting during work. Another method is to reach across the body for the firearm with the non-dominant hand and remove the weapon from the holster. It can be difficult to release the retention device or devices in the holster when reaching across the body. Also, if the firearm is removed with this method, the firearm is not in a position to fire as the grip used to withdraw the firearm is backwards such that the user could not properly aim and fire the gun without repositioning it in his hand. To reposition the handgun will generally require placing the weapon under the arm or between the thighs to allow the user to reposition his hand and obtain a firing grip. Doing this allows for the possibility of dropping the firearm and leaving the user susceptible to sustaining injury due to the transitions needed to obtain a proper grip on the firearm.

Once the firearm is withdrawn using the non-dominant hand, reloading and re-holstering the firearm becomes difficult and dangerous, as it requires again placing the firearm between the user's thighs or under arm. Safe and quick access to reloading and re-holstering is not a practical option with either of the current training methods. These methods are slow and dangerous, putting police and military lives in jeopardy by not allowing for quick and safe access to the handgun with the non-dominant hand.

The present invention is a holster that is rotatably connected to the user's belt or other attachment point. In the normal position, the holster holds the handgun like any other conventional holster. Thus when viewed from above, the grip of the handgun points back toward the user. When in the open position, the holster rotates such that the grip of the handgun faces forward away from the user. The holster is attached to the belt with a hinge or hinge-like apparatus. In the open position, the handgun can be readily drawn and re-holstered with the non-dominant hand. In one embodiment, a locking means is employed such that the holster can be locked at one or more rotation angles. When locked in a substantially-open position, the user has quick, safe, and effective drawing, holstering and reloading using the non-dominant hand. The angle of rotation is only limited by the belt or the user's body. Any angle from zero degrees (handgun grip facing back) to 180 degrees (grip facing straight out) to further (beyond 180 degrees such that grip is pointed toward non-dominant hand and lying against the body) is possible. One embodiment is a standalone holster while another is an add-on apparatus to work in conjunction with commonly used police and military holsters. This add-on embodiment of the invention is designed to bolt or otherwise attach to existing tactical and duty holsters such as, but not limited to, those made by SAFARILAND®. Little-to-no modification or fabrication to the existing holster would be required. Both right-hand and left-hand embodiments are envisioned.

SUMMARY OF THE INVENTION

Accordingly, the present invention, in any of the embodiments described herein, may provide one or more of the following advantages:

It is an object of the present invention to provide a mounting assembly for securing a firearm holster to a user that permits the holstered weapon to be rotated from a normal position to a reversed position in which the weapon is more easily accessible to a non-dominant hand. The mounting assembly includes a first portion that is generally fixed to a user, preferably to a user's' belt, and a second portion hingedly connected to the first portion in a manner allowing rotation about a generally upstanding axis between a normal position which enables the user to draw the weapon using a dominant hand and a reversed position that rotates the holstered weapon to enable the user to conveniently draw the weapon using an off-hand. A conventional holster is connected to the second portion. Mounting assembly parts are manufactured from light weight, durable, and non-corrosive material such as titanium, stainless steel, aluminum or plastic.

It is another object of the present invention to provide a mounting assembly for securing a weapon holster to a user that permits the holstered weapon to be rotated from a normal position to a reversed position in which the weapon is more easily accessible using a non-dominant hand wherein the rotating mechanism includes provisions to retain the holster in one or more preferred positions including at least the normal position and preferably including the reversed position. The mounting assembly includes two parts rotatably connected which could be by a pinned hinge, bolt and socket, pintle and grudgeon, ball and socket, or other means.

Another object of the present invention is to provide a mounting assembly for a firearm holster enabling rotation of the holster for more convenient user access to a holstered weapon using a non-dominant hand that allows the rotatable connection to be locked in a substantially open, substantially closed, or any other position. Such locking may be accomplished by any suitable means such as simple friction, a spring-loaded pin and socket, or interlocking teeth. In one embodiment, the rotating mechanism includes a rotating portion to which the holster is connected that is also configured for vertical displaced along the rotational axis. One or more detents are provided on the rotating mechanism into which a fixing structure may be engaged when the holster at a predetermined holster rotational position. A biasing mechanism moves the rotating portion so that the fixing structure is engaged in the detent thereby precluding further rotation until the rotating portion is displaced in the opposite direction to disengage the fixing structure.

It is still another object of the present invention to provide a mounting assembly for a firearm holster enabling rotation of the holster for more convenient drawing of the weapon using a non-dominant hand that includes a biasing system to urge the rotating portion and holster to a preferred position under certain conditions. In one embodiment, the rotating portion is releasably latched into a normal position which allows a user easy access to the holstered weapon using a dominant hand. When released, the biasing mechanism urges the rotating portion and holster to the reversed position and maintains it in that position to allow use and re-holstering of the weapon using the non-dominant hand. The user may then choose to return the rotating portion to the normal position for use by the dominant hand.

It is yet another object of the present invention to provide a mounting assembly for a firearm holster enabling rotation of the holster for more convenient drawing of the weapon using a non-dominant hand that includes provisions to stabilize the mounting platform when in the normal position so that the mounting platform performs as a normally-mounted holster. One or more latches may be provided to secure the rotating portion of the mounting assembly to the fixed portion when positioned in the normal position. The latches are configured to disengage when actions are taken to reposition the rotating portion to the reversed position.

Still another object of the present invention is to provide safety features for a firearm holster mounting assembly enabling rotation of the holster for more convenient drawing of the weapon using a non-dominant hand that prevent inadvertent movement of the mounting assembly from at least the normal position. The rotating mechanism permitting selective rotation of a rotating portion and holster includes a primary mechanism for releasing the rotating portion for rotation and may include a second latching mechanism requiring motion distinct from the motion needed to release the primary mechanism. In one embodiment, a primary releasing mechanism is provided that requires displacing the rotating portion downwardly along the rotating axis. A secondary latch is provided which requires movement of a lever, preferably in a direction different from the downward displacement motion, which once unlatched permits the downward displacement.

Yet another object of the present invention is to provide a mounting assembly for a firearm holster enabling rotation of the holster for more convenient drawing of the weapon using a non-dominant hand that features a connection configuration found on the most popular police and military tactical style holsters.

It is a still further object of the present invention to provide a mounting assembly for a firearm holster enabling rotation of the holster for more convenient drawing of the weapon using a non-dominant hand that is durable in construction, inexpensive of manufacture, carefree of maintenance, easily assembled, and simple and effective to use.

These and other objects are achieved in accordance with the present invention by providing a mounting assembly for securing a firearm holster to a user that permits the holstered weapon to be rotated from a normal position to a reversed position in which the weapon is more easily accessible to a non-dominant hand. The mounting assembly includes a first portion that is generally fixable to a user and a second portion hingedly connected to the first portion in a manner allowing rotation about a generally upstanding axis. The second portion, having a holster connected thereto, is rotatable between a normal position which enables the user to draw the weapon using a dominant hand and a reversed position in which the holster is rotated to enable the user to conveniently draw the weapon using an off-hand. The assembly includes provisions to restrain the second portion in one or more predetermined orientations, biasing mechanisms to rotate the second portion when released, and latching mechanism to prevent inadvertent or unintended rotation of a holstered weapon.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "up" or "down," or "top" or "bottom" are used as a matter of mere convenience, and are determined as the holster would typically be oriented on a standing user when worn at the user's waist. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail. When referring to the figures, like parts are numbered the same in all of the figures. The inclusion of an alpha designation in a reference number indicates a structure or feature used in multiple locations on a part.

Figure 1:
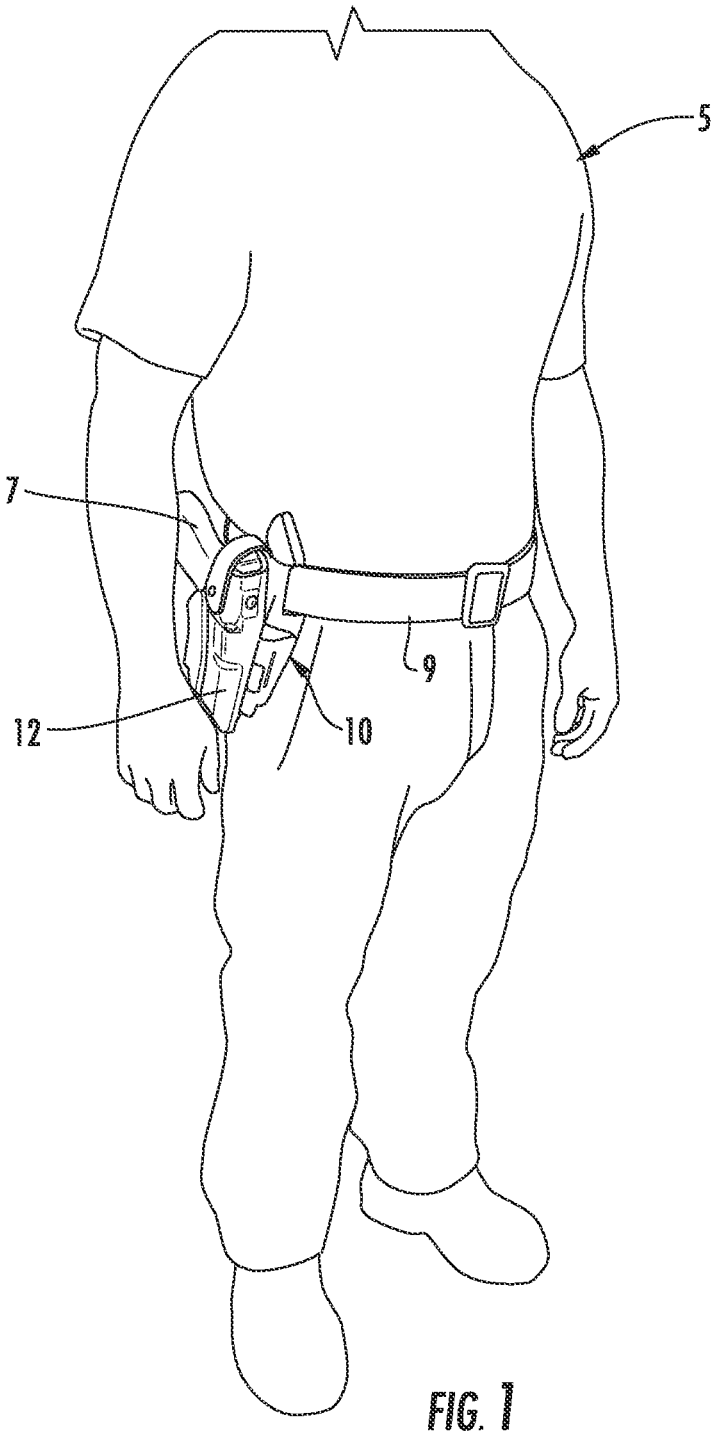
FIG. 1 is a front view of a typical user having a belt-mounted firearm holster of the type on which the present invention is useful wherein the holster is as normally positioned for use.
Figure 2:
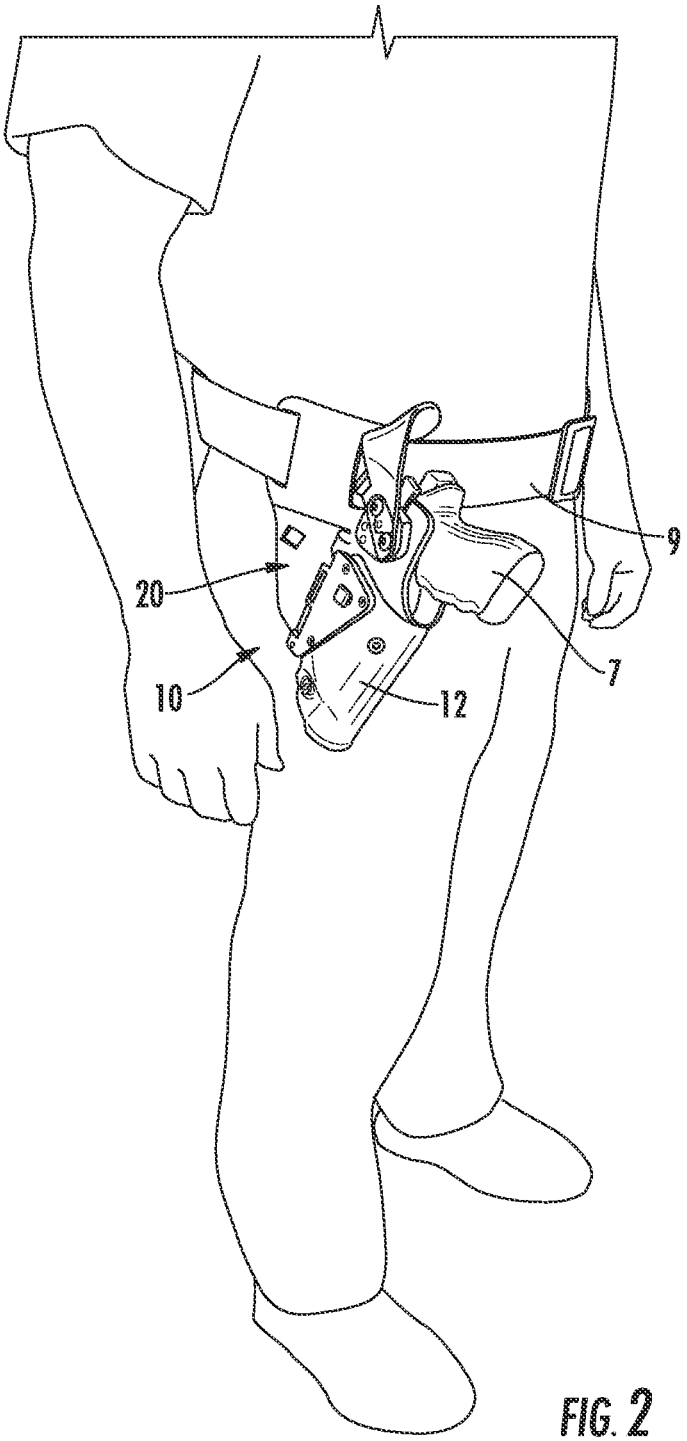
FIG. 2 is a partial front view of the user pictured in FIG. 1 wherein the holster is positioned for an off-hand draw of a weapon.
Figure 3:
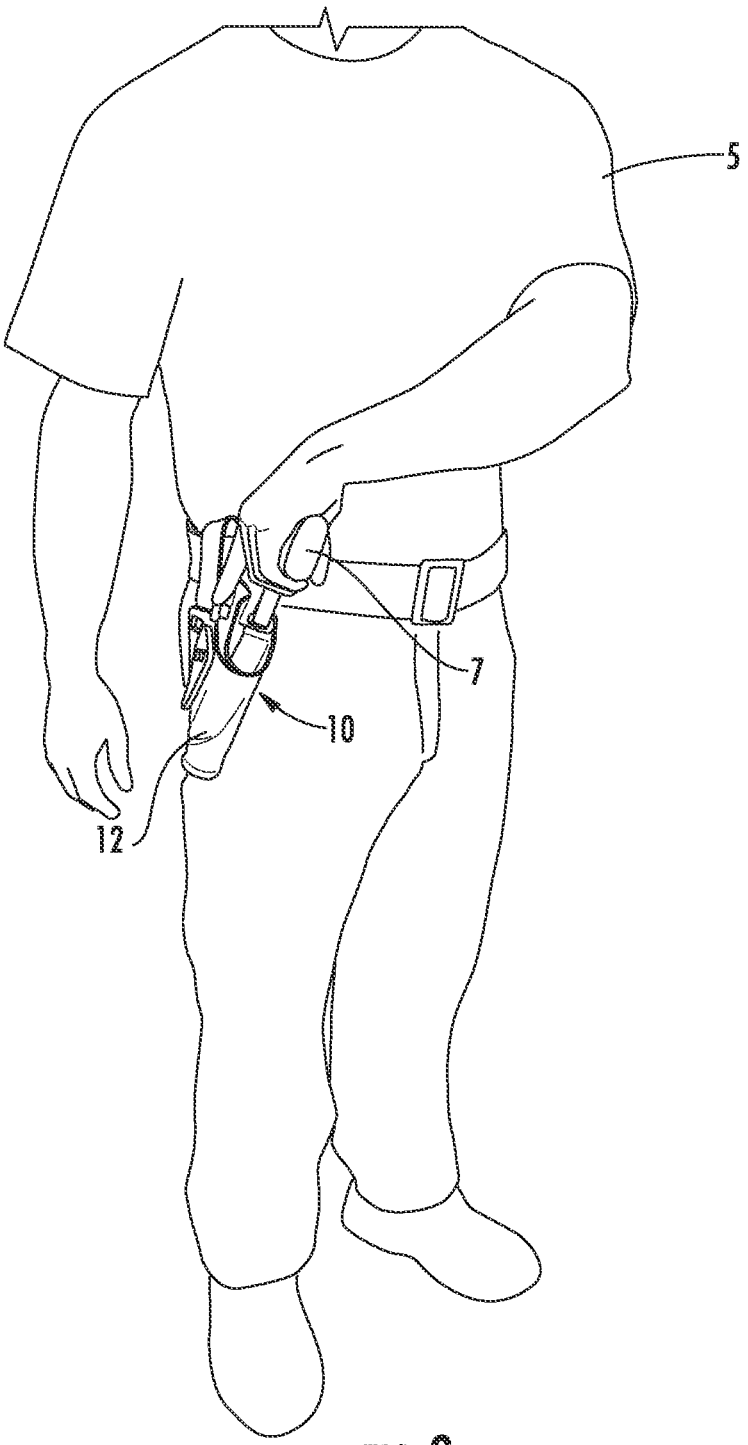
FIG. 3 is a view of the user in FIG. 2 accessing a firearm from the holster while it is positioned for off-hand drawing.
Figure 4:
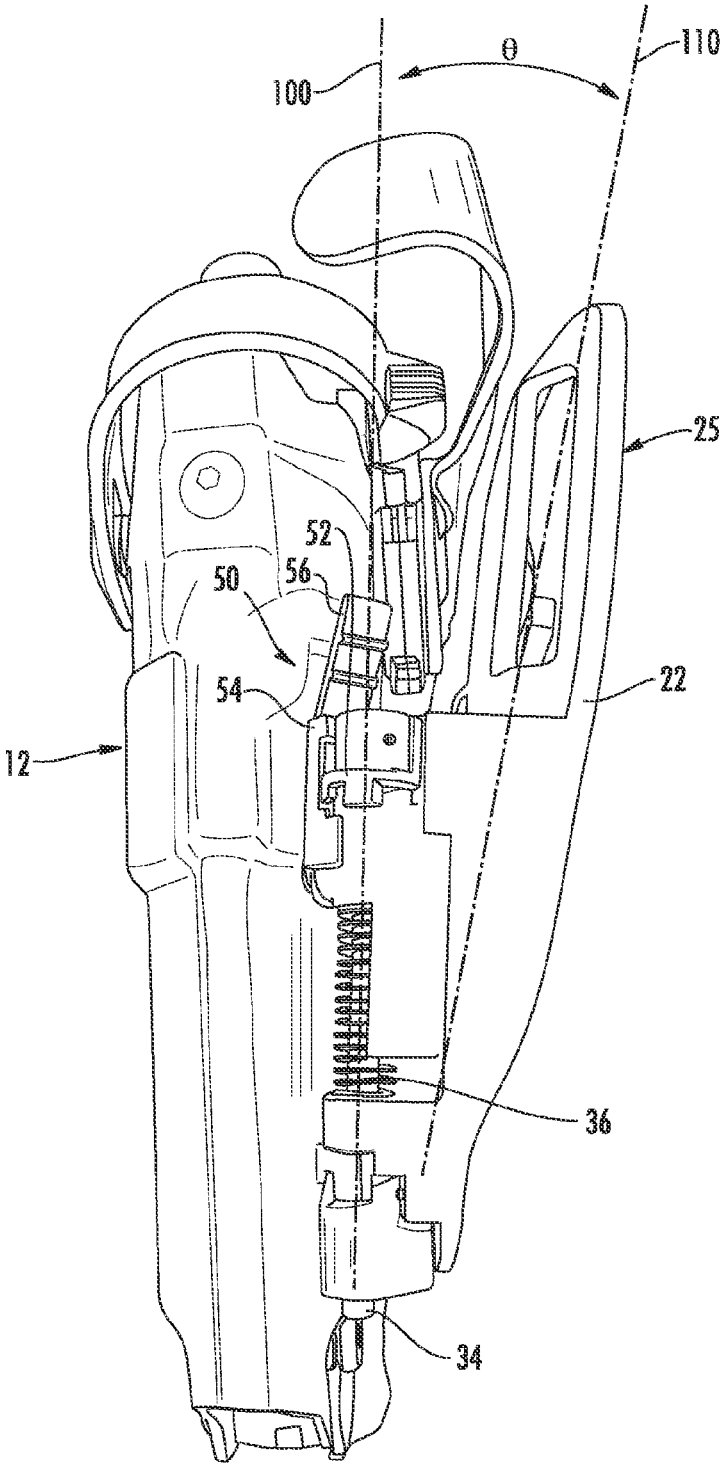
FIG. 4 is a first elevation view of the holster mounting platform of the present invention shown positioned in a normal position.
Figure 5:
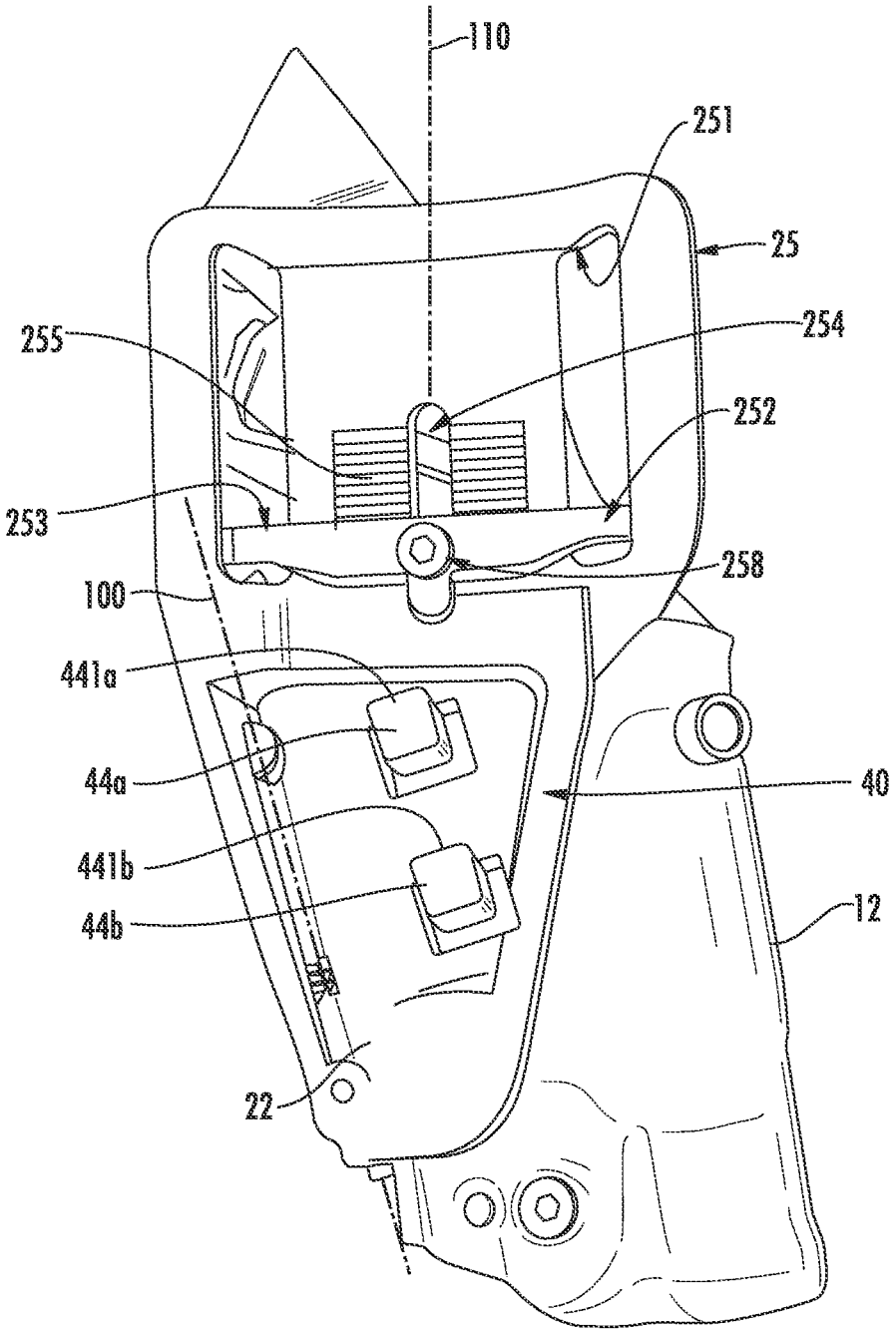
FIG. 5 is a side elevation view of the holster mounting platform of FIG. 4.
Figure 6:
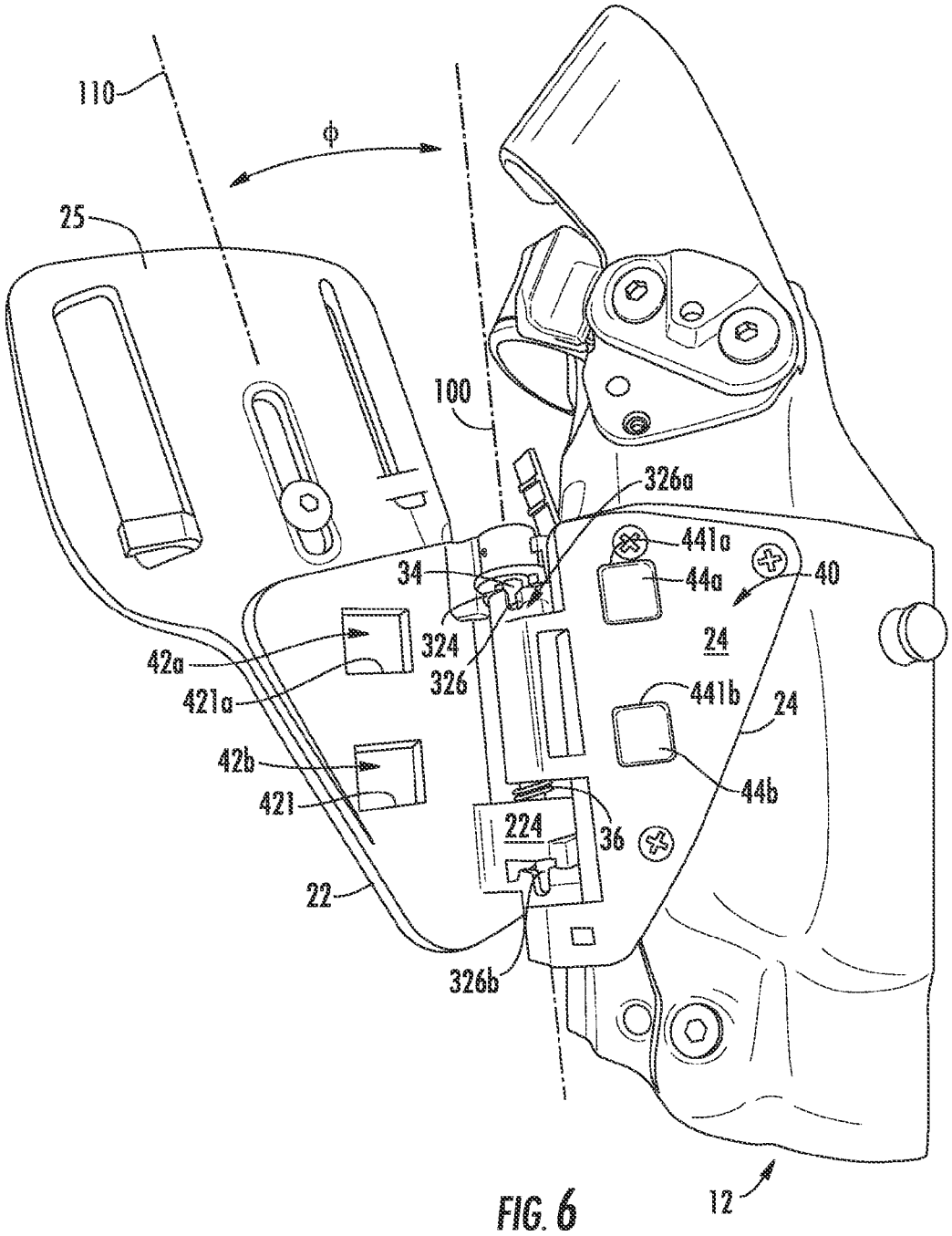
FIG. 6 is view of the holster mounting platform shown in the reversed position with the holster plate locked in place.
Figure 7:
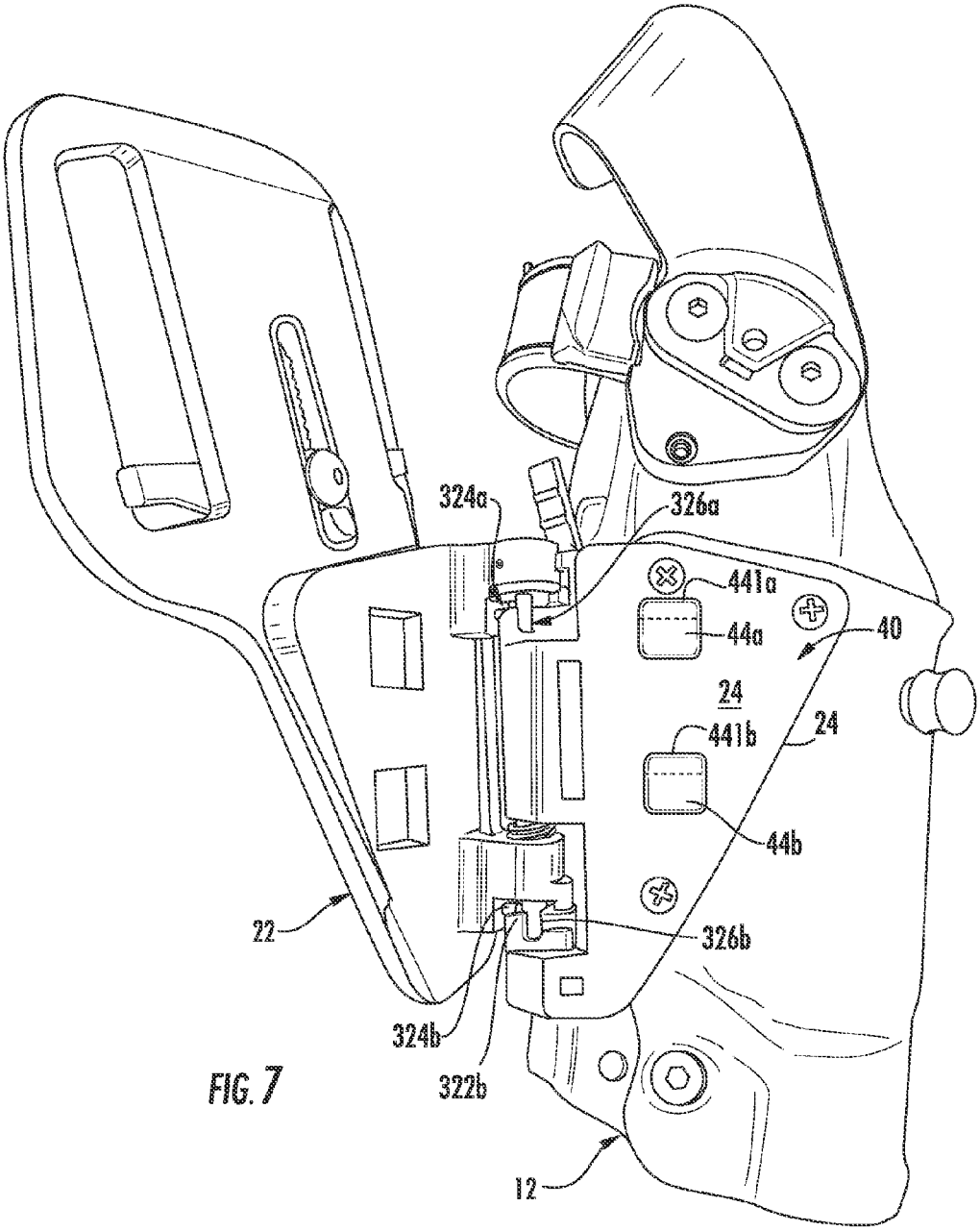
FIG. 7 is a view of the holster mounting platform of FIG. 6 shown intermediately positioned between the normal and reversed positions with the holster plate free to rotate.
Figure 8:
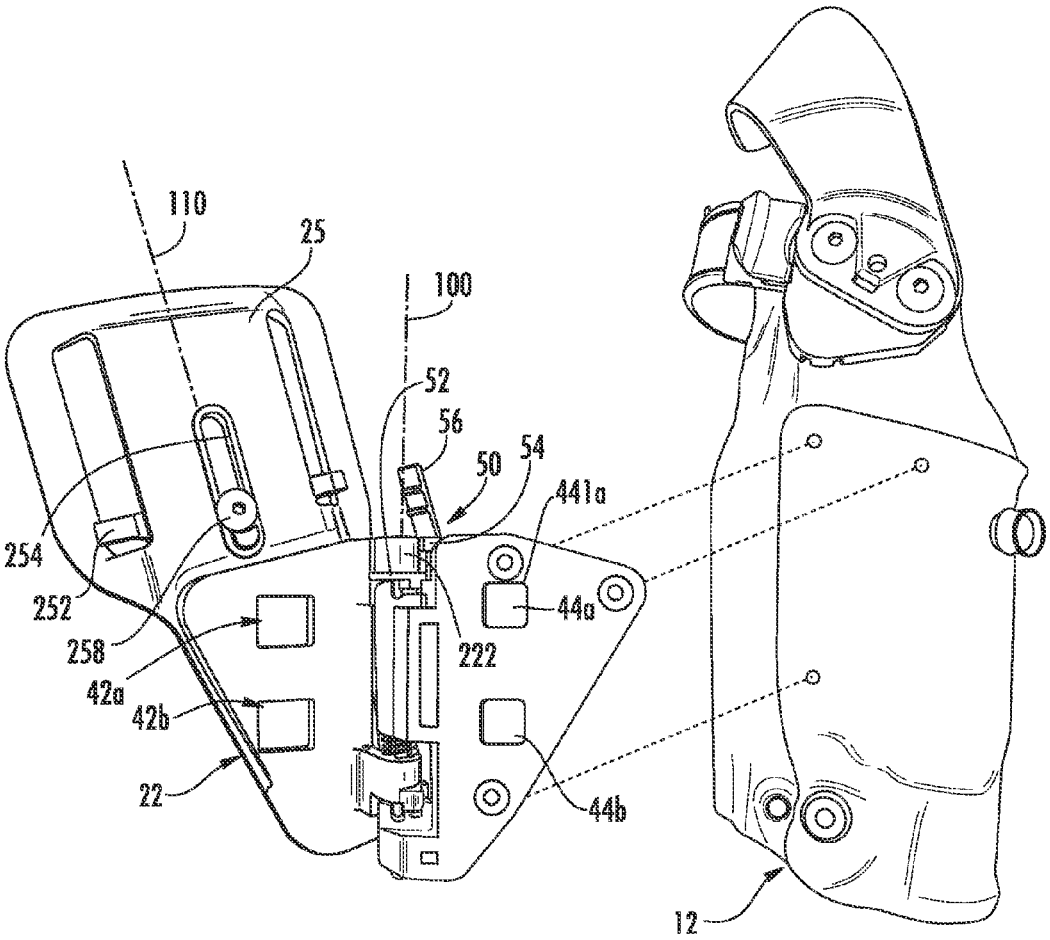
FIG. 8 is an exploded view of the holster mounting platform showing details of the rotating and latching mechanisms.

In FIGS. 1 through 3, there is illustrated a typical firearm user 5 wearing a hip-mounted holster assembly 10 for conveniently securing a weapon 7 to the user. The holster assembly 10 comprises a conventional holster 12 configured to receive and hold the weapon 7, and a rotatable mounting platform 20 for connecting the holster 12 to a belt 9 worn by the user. In FIG. 1, the user is standing normally with the holster assembly 10 positioned as it would be for normal use with the grip oriented rearwardly in relation to the user, a right-handed shooter in this illustration. In FIG. 2, the holster assembly 10 is repositioned to allow the user to easily draw the weapon 7 using his off-hand (left handed in the illustration) wherein the weapon has been rotated about an upstanding axis to reposition the grip forwardly in relation to the user. FIG. 3 shows the user reaching across with his off hand to draw the weapon. The repositioned (reversed) holster assembly allows the user to draw the weapon with his off-hand without need to reposition the weapon after drawing.

Now referring to FIGS. 4 through 8, the holster assembly 10 includes the mounting platform 20 comprising a first portion 22, also referred to as a stationary portion, and a second portion 24, referred to as a moveable portion, connected by a hinge 30. The first portion 22 includes means for securing the mounting platform 20 to a user's person, preferably a duty belt 9 or the like. The illustrated first portion 22 includes a loop connector 25 for receiving a user's belt or the like and allowing the mounting platform 20 to be easily positioned adjacent to a user's waist and oriented along a generally upstanding axis 110 which is generally vertically oriented when the user is standing with the holster assembly normally positioned alongside the waist. Alternatively, the first portion 22 may also include other known means, such as clamps, clips, or fasteners, for securing the mounting platform to a tactical belt or the like.

The loop connector 25 may include provisions for selective adjustment of the size of the loop opening to allow a secure engagement with the belt around which the loop is positioned. An adjustment bar 252 is preferably provided having an edge 253 aligned generally parallel to the belt 9 extending through the loop. An adjustment slot 254 in the first portion enables the adjustment bar position to be altered so that spacing between the edge 253 and a distal end of the loop opening 251 to match the width of the belt 9. Detents 255 or similar structures may be provided to aid in the positioning of the adjustment bar 252 or to increase the effectiveness of a clamp 258 mechanism securing the adjustment bar 252 to the first portion 24.

The second portion 24 is configured to allow attachment of the holster 12 by conventional means, preferably threaded fasteners as illustrated in the figures. The holster 12 may be configured to fit a particular type or model of weapon, to provide specific safety features for securing the weapon in the holster, or a combination of the two. Holsters 12 are well-known and often customized to fit a specific make and model of weapon and feature standardized connections for fitting the holster to a backing plate which is, in turn, attached to a user's belt.

The hinge 30 connecting the first and second portions includes first lugs 222, 224 extending from the first portion 22 and second lugs 242, 244 extending from the second portion 24. At least two pairs of first and second lugs are preferred; additional pairs may be incorporated to strengthen the hinge 30. A hinge pin 34 joins the lugs in a manner enabling a first movement mode comprising pivoting movement of the second portion 24 relative to the first portion 22 about a generally upstanding pivot axis 100 between a normal or first position (see FIG. 1) and a reversed or second position (see FIG. 2). The pivot axis 100 is preferably spaced away from the user (defined by a plane extending vertically through the loop connector 25) to minimize interference with the user's body during pivoting movement. The second portion may be rotated from the first position by as much as 270 degrees, though contact with the user's body may limit the amount of second portion rotation. Preferred normal rotation ranges from 130 to 180 degrees. The embodiment illustrated shown a normal rotation range of approximately 140 degrees between the normal and reversed positions. The pivot axis 100 may be generally vertically oriented and parallel to the user's body when the user stands erect with the holster assembly 10 positioned for use. It is preferred to slightly angle the pivot axis from vertical to enable the weight of the holster 12 and weapon to assist in rotation of the second portion and attached holster.

The location of the pivot axis 100 may also be varied in the forward-rearward direction. The preferred location is positioned adjacent to the forward end of the holster, typically adjacent to the location where the weapon barrel (normal top of the weapon) is located when holstered. A more forward position of the pivot axis 100 results in more forward displacement of the weapon position when the mounting assembly is in the reversed position. A more rearward pivot axis position reduces the extension of the mounting assembly when reversed. An excessively forward position of the pivot axis 100 may result in inadequate or awkward clearance with the user's arm while the mounting assembly is being pivoted. Similarly, a pivot axis position that is adjacent to the weapon grip may not provide sufficient forward displacement when moving to the reversed position for convenient non-dominant hand access to the weapon.

The relative positioning of the first and second lugs 222, 224, 242, 244, also enables a second mode of movement comprising relative bi-directional movement of the first and second portions in the direction of the pivot axis 100 between a latched position and a generally opposing released position. It is preferred that the second portion be at the upper extent of axial travel when in the latched position and downwardly displaced to achieve the released position. A spring 36 is provided to bias the second portion 24 in an upward direction (latched position) along the hinge pin pivot axis 100 with respect to the first portion 22.

The hinge 30 also includes a rotation mechanism 32 for causing the second portion 24 to rotate with respect to the first portion 22 under certain conditions and a means to secure the second portion in one of at least two rotational positions corresponding to the normal and reversed positions, shown in FIGS. 1 and 2, respectively. In one embodiment, a cam 322 and follower 324 are provided mounted on at least one of the second or first portions. The upward bias force of spring 36 on the second portion 24 urges the cam 322 against the follower 324. The contour of the cam 322 may be generally helical and configured such that the upward force of the spring 36 on the second portion 24 forces the cam follower 324 to follow the cam profile and thereby rotate the second portion 24 toward the second position. The cam 322 includes detents 326, 327 disposed at opposing ends of the cam profile and correspond to the rotational first and second positions, respectively, of the second portion 24. The detents are configured to allow the second portion 24 to move upwardly in the direction of the pivot axis 100 urged by the biasing force of spring 36 when the second portion 24 is rotationally positioned to align the cam follower 226 with one of the detents 326, 327. Once the cam follower 226 is engaged in one of the detents 326, 327, rotational movement of the second portion 24 is impeded so that the second portion 24 and attached holster 12 remains in a fixed rotational position in relation to the first portion 22. Moving the second portion 24 and attached holster 12 requires the user to push the holster downwardly to disengage the cam follower 324 from the detent and allow the second portion to rotate about the pivot axis 100 as the cam follower 324 follows the cam profile.

A cam 322 and cam follower 324 pair must be provided on at least one mating pair of first and second lugs 222, 242. Additional cams 322*b* and cam followers 324*b* may also be provided on each mating pair of lugs, lugs 224, 244 in the illustrated embodiment, to improve rotational operation of the mounting platform 20.

In an alternate embodiment, the rotational mechanism 32 may include a spring configured to cause rotation of the second portion 24 from the first position toward the second position when the second portion is moved from the latched position.

Another embodiment relies on an angled orientation of the pivot axis 100. In one embodiment, the pivot axis 100 is slightly forwardly angled ($\phi$) relative to the upstanding axis 110 such that the upper end of the pivot axis 100 is more forwardly positioned that the lower end of the pivot axis, relative to the front of the user. The effect of the angled orientation is a slight downward displacement of the center of mass of the second portion 24, holster 12, and any weapon secured in the holster which increases the tendency of the second portion 24 to move toward the reversed position when unlatched. The forward angle $\phi$ may range from 10 degrees to 25 degrees, with a forward angle of 15 to 20 degrees being preferred. The forward angle $\phi$ also improves ergonomics for non-dominant hand access to the weapon by lowering the weapon handle when in the reversed position. The pivot axis 100 may also be laterally angled ($\theta$) outwardly from the upstanding axis 110 for improved ergonomics. The lateral angle $\theta$ may range from zero to ten degrees with a lateral angle $\theta$ of five degrees outward being preferred.

To further improve stability when in the first (normal) position, a latch 40 may be provided to secure the first and second portions 22, 24 in the first position (FIG. 1). The latch 40 permits selective release by disengaging as the second portion 24 is moved downwardly toward the released position after which the second portion 24 may be rotated about the hinge pin axis 100 to the second position (FIG. 2). In the illustrated embodiment, the latch may comprise at least one lug 44 with a hook 441 connected to the second portion 24 and an aperture 42 define by a peripheral edge 421 in the first portion 22 into which the lug and hook may be inserted. When inserted and the second portion allowed to move upwardly to its fullest extent (latched position), the latch 40 is locked as the hook 441 engages an edge 421 of the aperture 42 and prevents the lug 44 from being removed from the aperture. Downward pressure on the second portion against the spring bias moves the second portion downwardly slightly, allowing the hook to clear the aperture edge and the lug and hook to disengage from the aperture. Once released, the second portion may then be pivoted toward the second position. Additional latches 40 may be provided for improved stability in the first position with two latches being preferred.

The weight of a weapon in the holster combined with movement of the user may cause downward movement of the holster and second portion 24 relative to the first portion 22 and unintentional release of the second portion from the normal first position. A safety catch 50 may be provided to reduce the chances of an unintentional release and rotation of the holster assembly to the second position. The catch 50 limits movement of the second portion 24 in the axial direction (vertical along the pivot axis 100) until the user selectively disengages the safety catch 50. In one embodiment, the catch 50 comprises a stop flange 52 positioned on at least one of the first lugs 222 of the first portion 24. The flange 52 extends circumferentially at least partially around the rotational axis 100 and is oriented generally radially therefrom. A catch tab 54 is connected to the second portion 24 by a movable extension 56 and positioned proximate to the flange 52. The extension 56 is preferable resilient enabling it to be flexed in a manner to move the catch tab 54 to a free position outside of the radial extent of flange 52. When so positioned, the first and second portions 22, 24 are permitted to move axially along the pivot axis 100 within limits of the rotational mechanism 32 and the arrangement of the first and second lugs 222, 224, 242, 244. Releasing the extension 56 while the second portion is not in the upward latched position returns the catch tab to a position in contact with the outer periphery 522 of the flange 52. With the catch tab 54 in this position, the second portion 24 may continue to rotate about axis 100. When the second portion 24 is positioned in either the first (normal) or second (reversed) positions which allows the second portion to move upwardly along axis 100 into the latched position, the catch tab 54 moves upwardly above the flange 52 and is forced inwardly toward the axis 100 by the resilient extension 56 into a safe position. In the safe position, the catch tab 54 is positioned adjacent to the face 524 of the flange 52 which inhibits movement in the axial direction, thereby reducing the likelihood of an unintended downward movement of the second portion and subsequent potential release from the first position.

Naturally, the invention is not limited to the foregoing embodiments, but it can also be modified in many ways without departing from the basic concepts. Changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

We claim:

1. A holster assembly for a weapon comprising:

a first portion having a connector configured for attachment to a user and defining an upstanding axis;

a second portion having a weapon holster attached thereto;

a rotating mechanism connecting the first portion and the second portion and configured to allow a first mode of movement in which the second portion rotates about a swing axis relative to the first portion between generally opposing normal and reversed positions, and a second mode of movement in which the second portion moves bi-directionally along the swing axis relative to the first portion between a latched position and a released position, the reversed position being angularly displaced more than 90 degrees from the normal position;

a biasing mechanism configured to rotate the second portion from the normal position toward the reversed position when the second portion is moved from the latched position to the released position; and a latching mechanism for inhibiting movement of the second portion in the first mode of movement when rotationally positioned in at least one predetermined rotational position and in the latched position, the latching mechanism allowing movement of the second portion in the first mode of movement from the normal to the reversed position when moved to the released position.

2. The holster assembly of claim 1, wherein the biasing mechanism includes a generally helical cam disposed on the first or the second portion, a cam follower disposed on the other portion, and a spring element for urging the cam follower in the second movement mode into contact with the cam causing rotation of the second portion in the first movement mode while the latching mechanism is in the released position.

3. The holster assembly of claim 2, wherein the latching mechanism comprises at least one detent formed in the cam, movement of the second portion into the latched position engaging the cam follower into the at least one detent.

4. The holster assembly of claim 1, wherein the at least one predetermined rotational position includes the normal position.

5. The holster assembly of claim 1, wherein the at least one predetermined rotational position includes the reversed position.

6. The holster assembly of claim 1, wherein the latching mechanism further comprises a hook disposed on the first or the second assembly portion, and an aperture disposed on the opposing assembly portion, the hook being insertable into the aperture by movement of the second portion toward the normal position when the second portion is in the released position, the hook engaging the aperture and preventing movement of the second portion in the first movement mode when the second portion is in the latched position.

7. The holster assembly of claim 1, wherein the latching mechanism further comprises a selectively releasable catch mechanism having a safe position and a free position, the catch mechanism inhibiting second movement mode movement of the second portion from the latched position when in the safe position and permitting second movement mode movement of the second portion when in the free position.

8. The holster assembly of claim 7, wherein the catch mechanism includes a flange connected to the second portion and moveable therewith, the flange extending radially outwardly from the axis to a peripheral end and having a face generally perpendicularly oriented to the swing axis, the catch mechanism further having a moveable block connected to the first portion by a flexible extension enabling movement between the safe and free positions, the flexible extension being biased toward the safe position, the block contacting the peripheral end of the flange when in the free position thereby permitting movement of the second portion in the second movement mode, the block contacting the face when in the safe position thereby inhibiting second portion movement in the second movement mode from the latched position.

9. The holster assembly of claim 2, wherein the biasing mechanism includes a spring configured to move the second portion in the first movement mode toward the reversed position.

10. The holster assembly of claim 9, wherein the latching mechanism further comprises a hook disposed on the first or the second assembly portion, and an aperture disposed on the opposing assembly portion, the hook being insertable into the aperture by movement of the second portion toward the normal position when the second portion is in the released position, the hook engaging the aperture and preventing movement of the second portion in the first movement mode when the second portion is in the latched position.

11. The holster assembly of claim 2, wherein the swing axis is angled in relation to the upstanding axis, the weight of the second portion and connected holster and a weapon housed within the holster bias movement of the second portion toward the reversed position.

12. The holster assembly of claim 11, wherein the upstanding axis is generally parallel to a body of an erect-standing user and the swing axis is forwardly angled in the range of ten to twenty-five degrees.

13. The holster assembly of claim 12, wherein the swing axis is outwardly angled from the upstanding axis in the range of one to ten degrees.

14. A holster assembly for a weapon comprising:

a first portion having a connector configured for attachment to a user and defining an upstanding axis;

a second portion having a weapon holster attached thereto, the weapon holster having a forward end and a rearward end;

a rotating mechanism connecting the first portion and the second portion and configured to allow a first mode of movement in which the second portion rotates about a swing axis relative to the first portion between generally opposing normal and reversed positions, and a second mode of movement in which the second portion moves bi-directionally along the swing axis relative to the first portion between a latched position and a released position, the swing axis being disposed adjacent to and angled in relation to the upstanding axis, the reversed position being angularly displaced more than 90 degrees from the normal position to enable user access to the weapon with an opposite hand from a hand normally used to draw the weapon;

a biasing mechanism configured to rotate the second portion from the normal position toward the reversed position when the second portion is moved from the latched position to the released position; and a latching mechanism for inhibiting movement of the second portion in the first mode of movement when rotationally positioned in at least one predetermined rotational position and in the latched position, the latching mechanism allowing movement of the second portion in the first mode of movement from the normal to the reversed position when moved to the released position.

15. The holster assembly of claim 14, wherein the biasing mechanism includes a generally helical cam disposed on the first or the second portion, a cam follower disposed on the other portion, and a spring element for urging the cam follower in the second movement mode into contact with the cam causing rotation of the second portion in the first movement mode while the latching mechanism is in the released position, and wherein the latching mechanism comprises at least one detent formed in the cam, movement of the second portion into the latched position engaging the cam follower into the at least one detent.

16. The holster assembly of claim 15, wherein the at least one predetermined rotational position includes the reversed position.

17. The holster assembly of claim 16, wherein the latching mechanism further comprises at least one hook disposed on the first or the second assembly portion, and at least one aperture disposed on the opposing assembly portion, the number of apertures being equal to the number of hooks, each aperture being configured to receive a hook by insertion into the respective aperture by movement of the second portion toward the normal position when the second portion is in the released position, the at least one hook engaging the respective aperture and preventing movement of the second portion in the first movement mode when the second portion is in the latched position.

18. The holster assembly of claim 17, wherein the latching mechanism further comprises a selectively releasable catch mechanism having a safe position and a free position, the catch mechanism inhibiting second movement mode movement of the second portion from the latched position when in the safe position and permitting second movement mode movement of the second portion when in the free position.

19. The holster assembly of claim 1, wherein the angular displacement of the second portion in the first mode of movement between the normal and reversed positions is in the range of 130 to 270 degrees.

20. The holster assembly of claim 14, wherein the angular displacement of the second portion in the first mode of movement between the normal and reversed positions is in the range of 130 to 270 degrees.

* * * * *